US006131006A

United States Patent [19]

Oogami

[11] Patent Number: 6,131,006

[45] Date of Patent: Oct. 10, 2000

[54] PHOTOSENSITIVE DRUM FOR ELECTROPHOTOGRAPHY

[75] Inventor: Hiroshi Oogami, Kashiwazaki, Japan

[73] Assignee: NEC Corporation, Tokyo, Japan

[21] Appl. No.: 09/313,843

[22] Filed: May 17, 1999

[30] Foreign Application Priority Data

May 20, 1998 [JP] Japan ..... 10-153707

[51] Int. Cl.[7] ..... G03G 15/00

[52] U.S. Cl. ..... 399/159

[58] Field of Search ..... 399/159, 162, 399/165, 167, 109, 117

[56] References Cited

U.S. PATENT DOCUMENTS

| | | | |
|---|---|---|---|
| 4,601,963 | 7/1986 | Takahashi et al. | 399/159 X |
| 5,430,526 | 7/1995 | Ohkubo et al. | 399/159 |
| 5,652,077 | 7/1997 | Obinata | 399/159 X |
| 5,669,045 | 9/1997 | Swain | 399/159 |

FOREIGN PATENT DOCUMENTS

| | | |
|---|---|---|
| 59-192279 | 10/1984 | Japan . |
| 60-163468 | 10/1985 | Japan . |
| 60-165969 | 11/1985 | Japan . |
| 63-13913 | 1/1988 | Japan . |
| 63-153572 | 6/1988 | Japan . |
| 63-249158 | 10/1988 | Japan . |
| 64-26882 | 1/1989 | Japan . |
| 64-72190 | 3/1989 | Japan . |
| 64-88485 | 4/1989 | Japan . |
| 1-171473 | 12/1989 | Japan . |
| 2-123971 | 10/1990 | Japan . |
| 3-179454 | 8/1991 | Japan . |
| 5-35125 | 2/1993 | Japan . |
| 5-94123 | 4/1993 | Japan . |
| 6-123309 | 5/1994 | Japan . |
| 7-104591 | 4/1995 | Japan . |
| 7-152285 | 6/1995 | Japan . |
| 7-281556 | 10/1995 | Japan . |
| 8-69233 | 3/1996 | Japan . |
| 8-135736 | 5/1996 | Japan . |
| 63-249159 | 10/1998 | Japan . |

OTHER PUBLICATIONS

Japanese Office Action issued Oct. 5, 1999 in a related application.

English–language translation of relevant portions of Oct. 5, 1999 Japanese Office Action.

*Primary Examiner*—Sandra Brase

*Attorney, Agent, or Firm*—Ostrolenk, Faber, Gerb & Soffen, LLP

[57] ABSTRACT

The photosensitive drum for electrophotograpy of the present invention comprises: a tubular photosensitive film; an elastic portion fit within the photosensitive film in contact with an inner surface of the photosensitive film; and a rod inserted into a hole of the elastic portion, an outside diameter of the rod being greater than an inside diameter of the hole so that the rod is tightly fit within the hole and that the elastic portion is elastically expanded and is pressed against the inner surface of the photosensitive film.

18 Claims, 6 Drawing Sheets

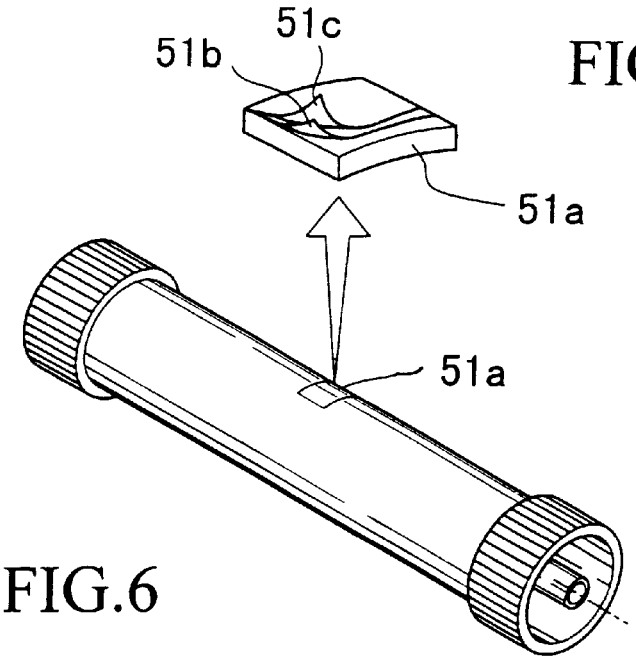
FIG.6A
FIG.6
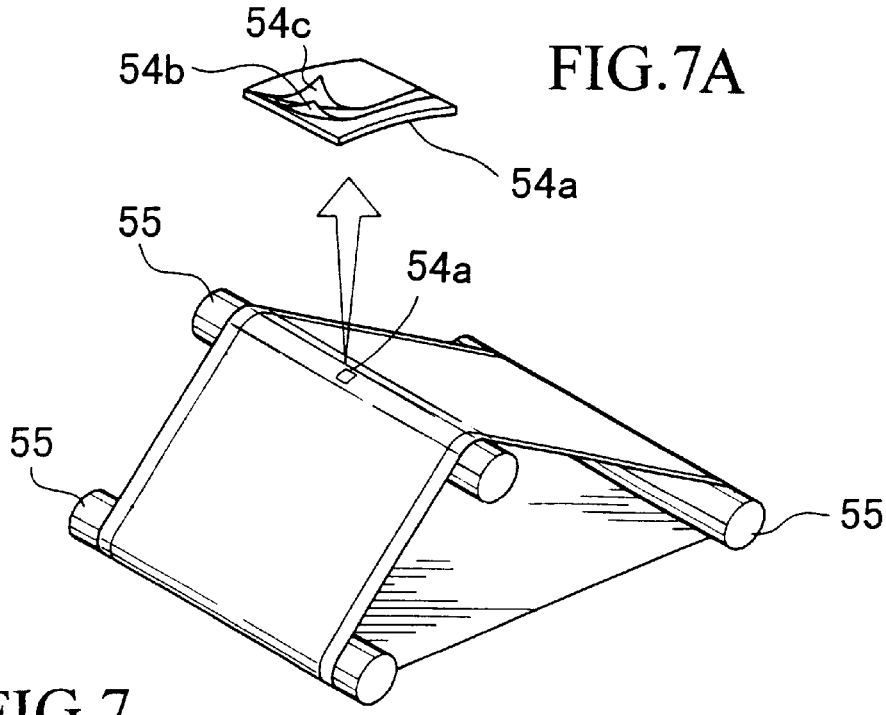
FIG.7A
FIG.7

PHOTOSENSITIVE DRUM FOR ELECTROPHOTOGRAPHY

BACKGROUND OF THE INVENTION

1. Field of the Invention

The present invention relates to a photosensitive drum for electrophotography.

This application is based on Japanese Patent Application No. Hei 10-153707, the contents of which are incorporated herein by reference.

2. Description of the Related Art Including Information Disclosed Under 37 CFR 1.97 and 1.98

FIGS. 6 and 6A show a conventional electrophotography recorder using a photosensitive component in which photosensitive layers 51*b* and 51*c* are formed on a metal (for example, aluminum) drum (tubular component) 81*a*. FIGS. 7 and 7A show another conventional photosensitive component with photosensitive layers 54*b* and 54*c* formed on tubular film 54*a*. The photosensitive component is supported by two or more rollers 55, the mechanical drum is expanded, and the drum is gripped using grooves on the drum.

To manufacture the photosensitive component using the metal drum, the photosensitive layer is formed directly onto the metal drum by deposition, sputtering, dip-coating, or spray coating. When the photosensitive layer is deteriorated and abraded, the entire drum must be exchanged. Alternatively, the photosensitive layer may be polished, or may be removed by a solvent, to recycle the drum.

When using the photosensitive component using the tubular film, the tubular film is supported by two or more rollers under an appropriate tension. Therefore, when the photosensitive layer is deteriorated or abraded, only the tubular film can be exchanged.

The conventional electrophotography recorder, however, requires particular mechanisms which support the photosensitive component under appropriate tension, and which prevent meandering of the rotating tubular film. Further, a complicated mechanism which enables exchange of the component is required.

There is a problem with the metal drum that it cannot be easily disposed of or recycled, which increases the costs.

Further, there is a problem with the tubular film that the complicated mechanisms are required to support, rotate, drive, and exchange the film, thus increasing the costs.

Japanese Unexamined Patent Application, First Publication No. Hei 08-069233, discloses a drum for electrostatic photography which includes a porous damper. The damper is pressed against the inner surface of the drum, but the pressure of the damper becomes irregular because the drum lacks a means for producing a uniform pressure on the drum.

Japanese Unexamined Patent Application, First Publication No. Sho 63-249158, discloses a drum accommodating an elastic material whose ends are pressed by flanges in the direction of the drum axis. However, the pressure of the elastic material onto the inner surface of the drum, in particular, around the middle of the drum, becomes low because the pressures is applied only at the ends.

Japanese Unexamined Patent Application, First Publication No. Hei 03-179454 discloses a drum with a rubber component accommodated therein. Gas is injected into the rubber component so that the rubber component is pressed against the inner surface of the drum, but the drum lacks appropriate stiffness and it may be distorted because it uses the gas.

Japanese Unexamined Utility Model Application, First Publication No. Hei 01-171473 discloses a photosensitive drum which includes an elastic component. The ends of the elastic component are pressed by flanges in the direction of the drum axis. However, the pressure of the elastic material onto the inner surface of the drum, in particular, around the middle of the drum, becomes low because the pressures is applied only at the ends.

Other conventional photosensitive drums or electrophotograpy devices are disclosed in Japanese Unexamined Utility Model Application, First Publication No. Sho 60-163468, Japanese Unexamined Utility Model Application, First Publication No. Sho 60-165969, Japanese Unexamined Patent Application, First Publication No. Hei 5-035125, Japanese Unexamined Patent Application, First Publication No. Sho 63-249159, Japanese Unexamined Patent Application, First Publication No. Sho 64-072190, Japanese Unexamined Patent Application, First Publication No. Hei 05-094123, Japanese Unexamined Patent Application, First Publication No. Sho 63-013913, Japanese Unexamined Patent Application, First Publication No. Hei 06-123309, Japanese Unexamined Patent Application, First Publication No. Hei 07-281556, and Japanese Unexamined Patent Application, First Publication No. Sho 63-153572. These references describes the drum with an elastic material inserted therein, but lack a means for regulating the appropriate pressure and stiffness throughout the drum.

BRIEF SUMMARY OF THE INVENTION

It is therefore an object of the present invention to provide a photosensitive drum which can reduce the costs, can be easily handled and can be recycled.

In order to accomplish the above object, the photosensitive drum for electrophotography of the present invention, comprises: a tubular photosensitive film; an elastic portion fit within the photosensitive film in contact with the inner surface of the photosensitive film; and a rod inserted into a hole of the elastic portion, the outside diameter of the rod being greater than the inside diameter of the hole so that the rod is tightly fit within the hole and that the elastic portion is elastically expanded and is pressed against the inner surface of the photosensitive film.

The elastic portion can be of rubber, foamed rubber, plastic, and foamed plastic. The rod can have a round cross-section, a polygonal cross-section, a spline shape, or a screw shape. The rod may be hollow. The elastic portion may have a sealed space surrounding the hole into which fluid or gas is injected so that the elastic portion is expanded. The rod extends over the full length of the elastic portion in the direction of the rotational axis of the tubular photosensitive drum. The photosensitive drum further comprises flanges with gears at both ends of the drum.

According to the photosensitive drum for electrophotography, the tubular photosensitive film can be easily exchanged, so that the main parts of the drum can be recycled at low cost.

By choosing an appropriate elastic modulus of the elastic portion supporting the tubular photosensitive film, the pressure between the contact surfaces of the processing parts is reduced, and abrasion of the surfaces of the photosensitive component and other parts can be reduced.

In another aspect, the electrophotography recorder of the present invention comprises a photosensitive drum, and the photosensitive drum comprises: a tubular photosensitive film; an elastic portion fit within the photosensitive film in contact with the inner surface of the photosensitive film; and a rod inserted into a hole of the elastic portion, the outside diameter of the rod being greater than the inside diameter of the hole so that the rod is tightly fit within the hole and that the elastic portion is elastically expanded and is pressed against the inner surface of the photosensitive film.

The elastic portion of the electrophotograpy recorder can be of rubber, foamed rubber, plastic, and foamed plastic. The rod can have a round cross-section, a polygonal cross-section, a spline shape, or a screw shape. The rod may be hollow. The elastic portion may have a sealed space surrounding the hole into which fluid or gas is injected so that the elastic portion is expanded. The rod extends over the full length of the elastic portion in the direction of the rotational axis of the tubular photosensitive drum. The photosensitive drum further comprises flanges with gears at both ends of the drum.

BRIEF DESCRIPTION OF THE DRAWINGS

FIGS. 6 and 6A are perspective views showing the conventional photosensitive drum.

FIGS. 7 and 7A are perspective views showing the other conventional photosensitive drum.

DETAILED DESCRIPTION OF THE INVENTION

The best mode of the photosensitive drum for electrophotography, according to an embodiment of the present invention, will be explained.

Figure 1:
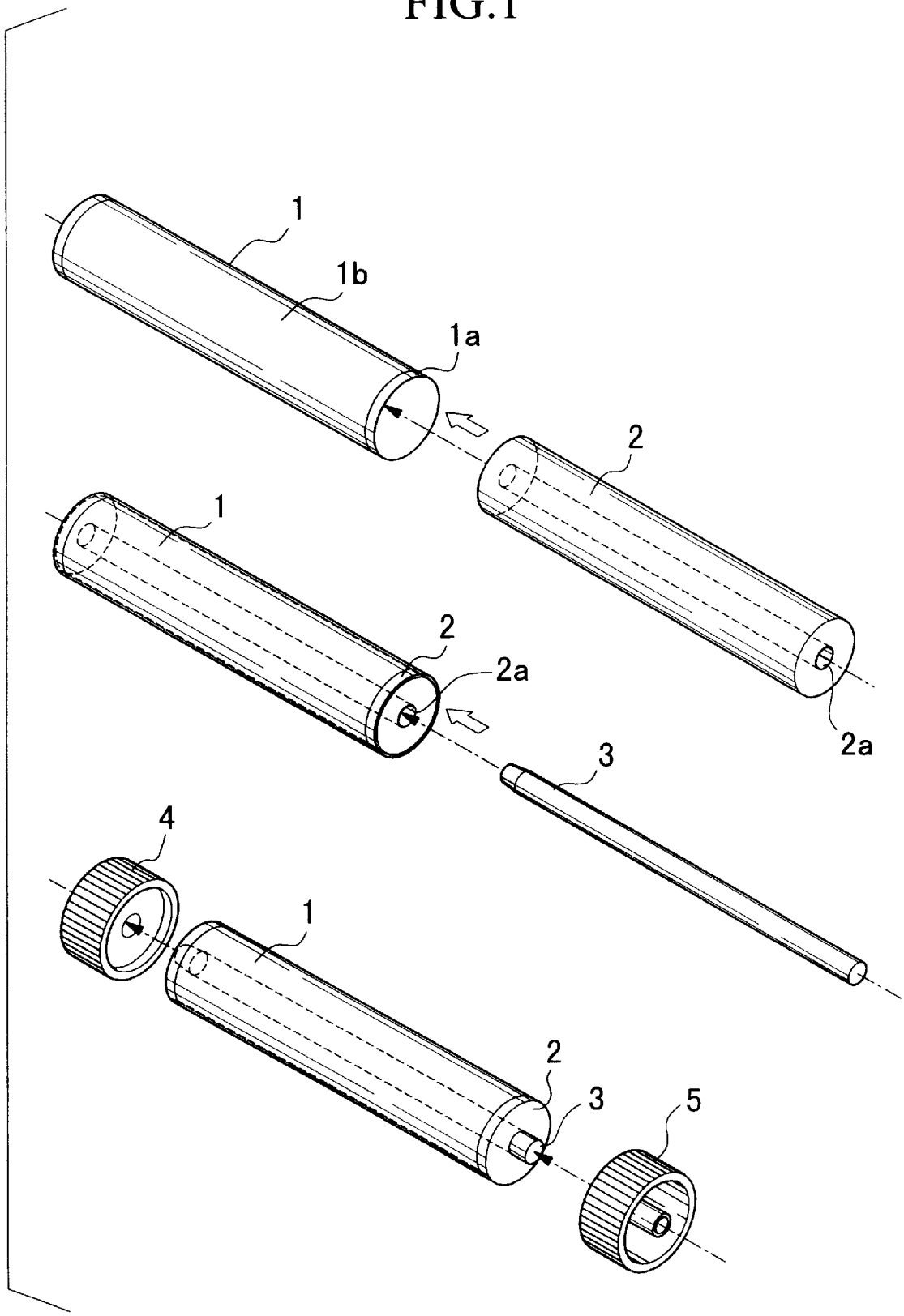
FIG. 1 is an exploded view showing the photosensitive drum of the embodiment according to the present invention and the assembling process of the main parts of the photosensitive drum.

The photosensitive drum comprises three main parts shown in FIG. 1, which is an exploded view also explaining the assembly of the drum.

A tubular photosensitive film 1 is manufactured by forming a photosensitive layer 1*b* on a base film 1*a* through an application process, an spray process, or sputtering. The base film 1*a* is made of, for example, a resin such as PET (polyethylene terephthalate) or nylon, or a metal sheet such as a stainless sheet or an aluminum sheet.

The base film undergoes a process for producing conductivity, and the photosensitive layer 1*b* is then formed. The photosensitive layer 1*b* has photosensitivity suitable for normal electrophotography, and is formed by applying, depositing, or sputtering a material which includes a charge generator, a charge transporter, and binder resin. The layer can be single, or several layers may be employed if necessary.

The elastic portion 2 has an outside diameter less than the inside diameter of the tubular photosensitive film 1, and a through hole 2*a* with an appropriate diameter at the center of the elastic portion 2. The elastic portion 2 is made of elastic material such as rubber, foamed rubber, plastic, or foamed plastic, and is preferably made of a material with a low compression set.

The rod 3 has an outside diameter larger than the inside diameter of the through hole at the center of the elastic portion 2, and is made of a material whose elastic modulus is higher than that of the elastic portion 2.

To assemble these parts, the elastic portion 2 is inserted into the inside of the tubular photosensitive film 1, and then the rod 3 is tightly inserted into the hole 2*a* of the elastic portion 2. The diameters of the parts are determined so that, as the outside diameter of the elastic portion 2 increases due to the insertion of the rod 3, the circumference of the elastic portion 2 is pressed against the inner surface of the tubular photosensitive film 1.

The hole 2*a* pierces the elastic portion 2, and the rod 3, which is inserted through the elastic portion 2, extends over the full length of the photosensitive drum in the direction of the longitudinal axis thereof, resulting in the uniform pressure of the elastic portion 2 onto the inner surface of the tubular photosensitive film 1 and the uniform stiffness throughout the photosensitive drum.

Figure 2:
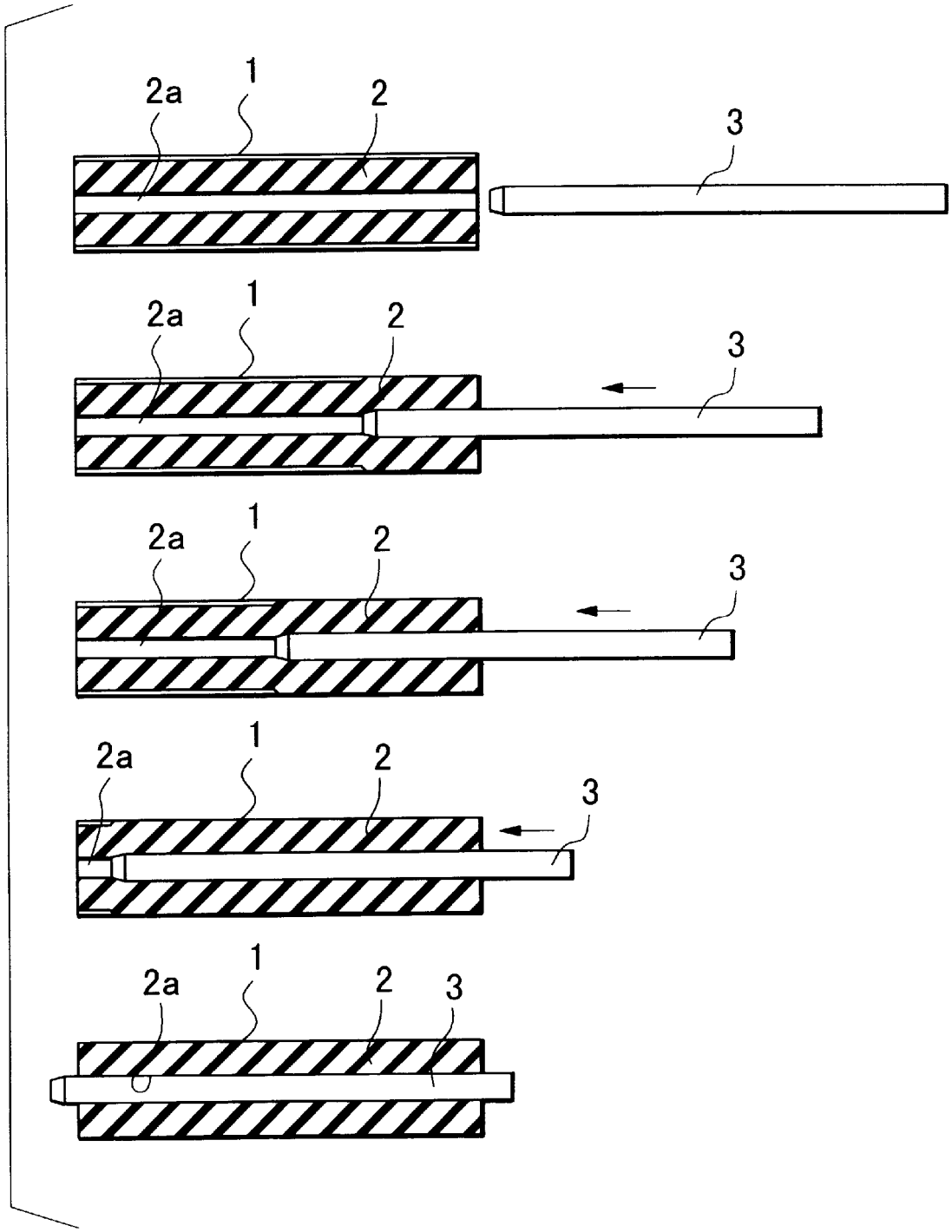
FIG. 2 is a cross-sectional view showing the process of inserting a rod into an elastic portion of the present invention.

FIG. 2 schematically shows the process of assembling the parts, in which, after the insertion of the elastic portion 2 into the tubular photosensitive film 1, as the rod 3 is tightly inserted gradually, the circumference of the elastic portion 2 is gradually expanded and is pressed against the inner surface of the tubular photosensitive film 1

Figure 4:
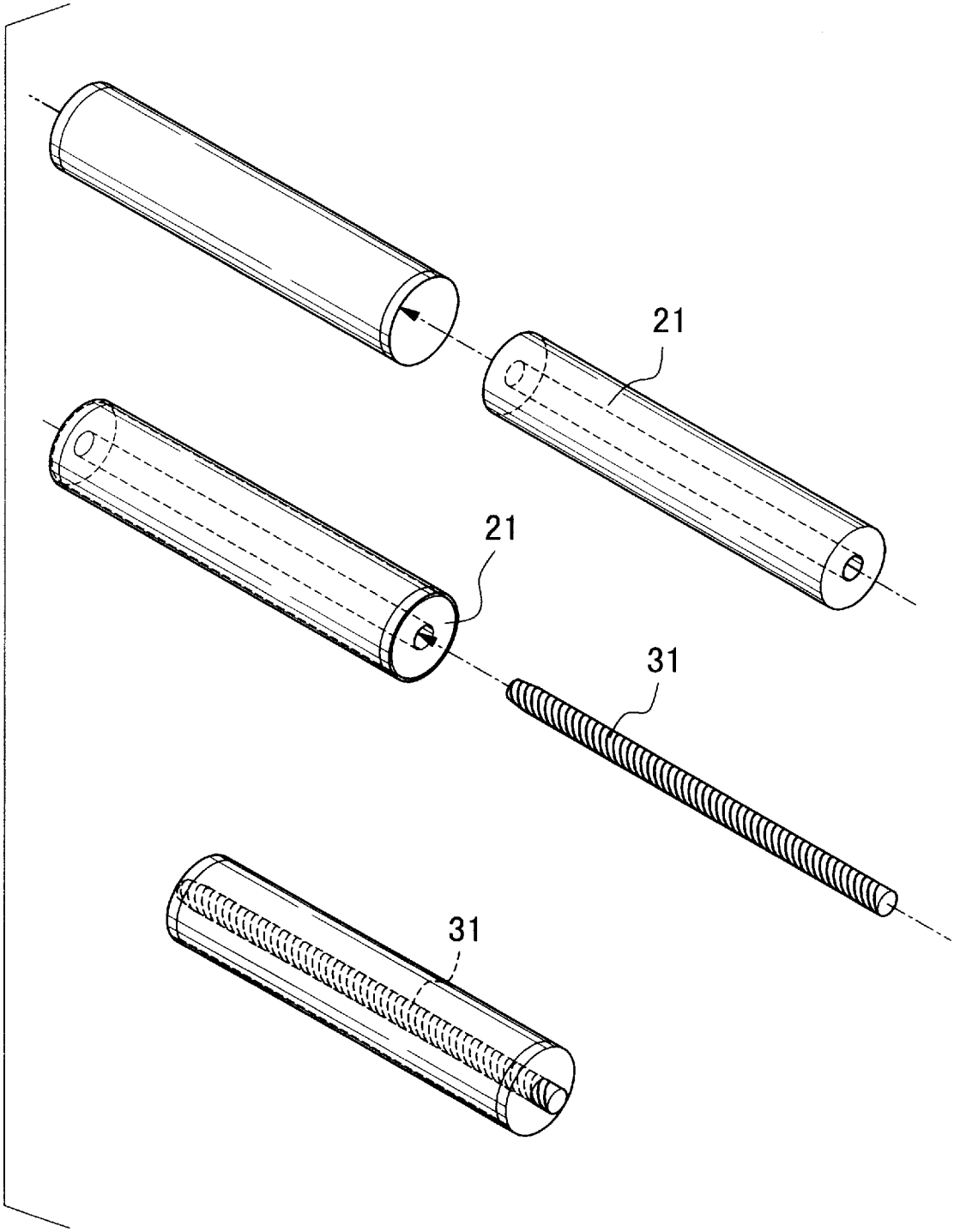
FIG. 4 is an exploded view showing the photosensitive drum of the other embodiment according to the present invention and the assembling process of the main parts thereof.

FIG. 4 shows another example of the rod in the process of assembling the parts. The rod 31 is a screw which can be tightened into the hole of the elastic portion 21.

The hole of the elastic portion 21 has a female screw on its inner surface whose diameter is smaller than that of the male screw of the rod 31. By tightening the screw rod 31, the outside diameter of the elastic portion 21 is expanded and is pressed against the inner surface of the tubular photosensitive film.

The rod may have a polygonal section such as a rectangular or regular-pentagonal section, or a spline shape. Depending on the shape of the rod, the hole of the elastic portion may be modified. For example, the rod may be hollow.

Figure 5:
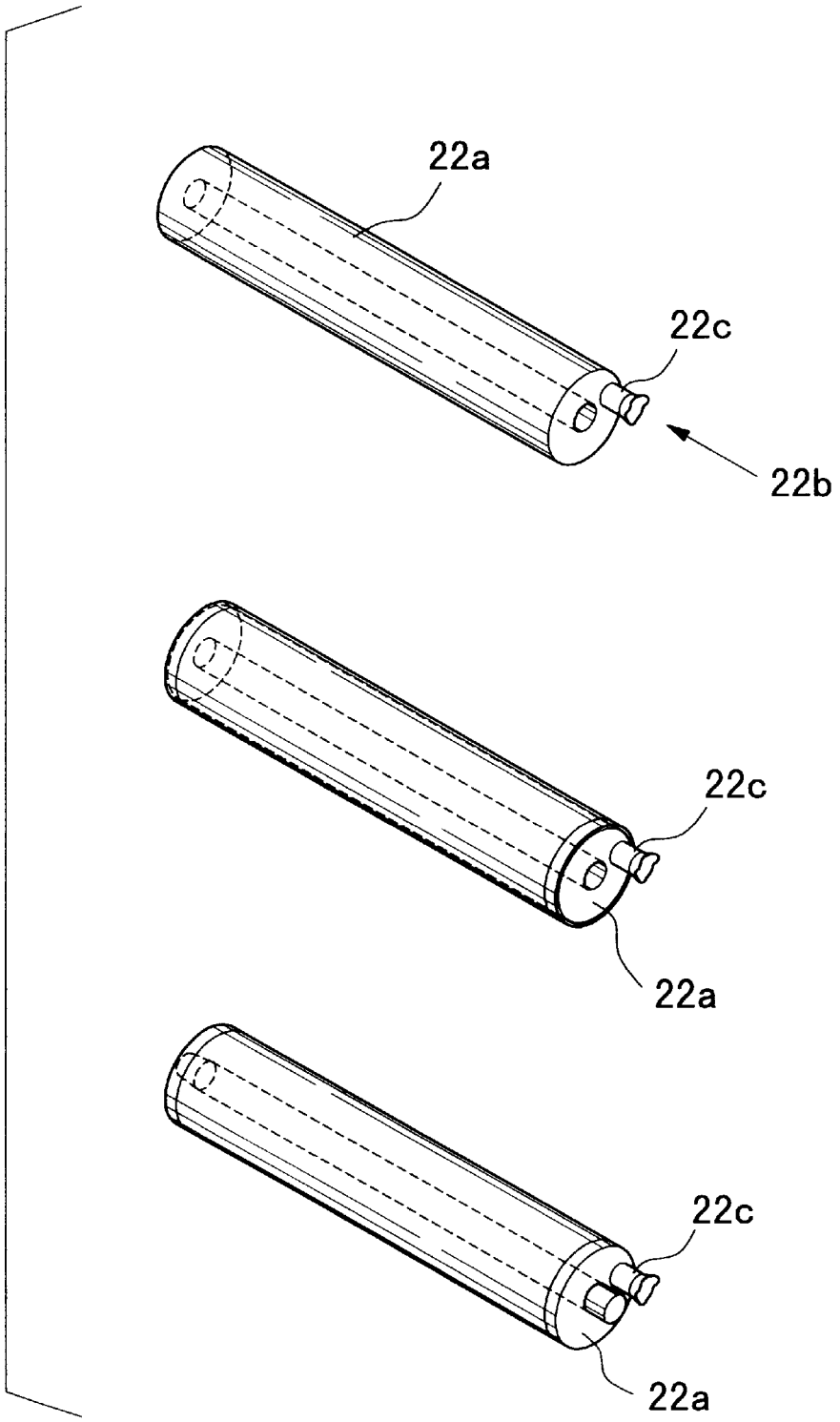
FIG. 5 is a perspective view showing the assembling process of the photosensitive drum of the other embodiment of the present invention.

FIG. 5 shows another example of the elastic portion. The elastic portion 22*a* is a "double hollow tube" with two spaces which are a through hole and a space surrounding the hole. Elastic fluid 22*b* is injected into the space, and then an injection hole 22*c* is sealed by, for example, thermocompression bonding. The elastic fluid may be a gas such as air or an inert gas, or a liquid such as water, oil, or gel. Alternatively, a foamed resin may be injected.

After the fluid 22*b* is injected into the double hollow tube, the rod is tightly inserted into the hole. In a manner similar to the embodiment shown in FIG. 1, the outside diameter of the rod is greater than the inside diameter of the hole so that the rod is tightly fit within the hole and that the double hollow tube elastic portion 22*a* is elastically expanded and is pressed against the inner surface of the photosensitive film. The double hollow tube elastic portion 22*a* with the injected fluid provides an appropriate elastic modulus, which is adjustable depending on the type of the fluid and the internal pressure of the fluid.

The completed rotable thermosensitive drum may be equipped with flanges 4 and 5 with gears. Alternatively, the gears are formed at the both ends of the rod 3. By driving the rod 3, the driving force is transmitted to the elastic portion 2 and to the tubular thermosensitive drum 1, so that these parts are rotated synchronously.

Figure 3A:
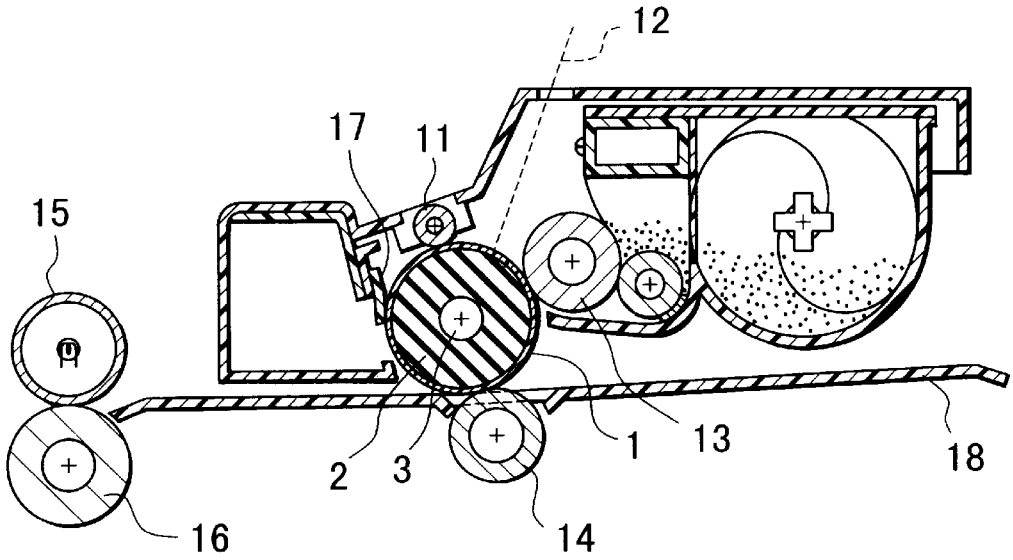
FIG. 3A is a cross-sectional view showing the processing parts of the electrophotography recorder of the present invention.
Figure 3B:
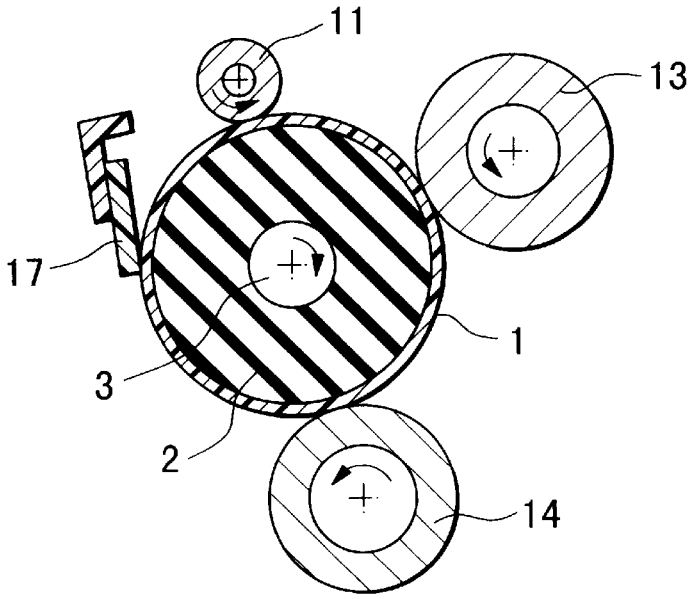
FIG. 3B is an enlarged cross-sectional view showing the parts around the photosensitive drum.

FIG. 3A is a schematic cross-sectional view of the processing part in the electrophotography recorder using the thermosensitive drum, and FIG. 3B is an enlarged view around the thermosensitive drum.

A charged roller 11, in contact with the tubular thermosensitive film 1 of the drum, negatively and uniformly charges the surface of the film 1. As the rotation continues, the charge is selectively neutralized by laser beam 12 so that a latent image appears. Subsequently, the negatively charged toner, which is supplied on the surface of the portion in contact with a developing roller 13, develops the latent image neutralized by the laser beam 12.

When a recording medium such as a paper (not shown) is guided by a paper guide 18 and is fed between the developing roller 13 and the photosensitive film 1, the image of the toner developed on the photosensitive film is printed on the recording medium by transfer bias applied to the developing roller.

The recording medium is fed between a heat roller 15 with a heater and a backup roller 16, and is then heated so that the image is fixed.

A cleaning blade beats and removes the toner which is not transferred and remains on the photosensitive film, and the photosensitive film returns to the charging process.

A drive unit which is not shown drives the rod 3 of the photosensitive drum. The driving force is transmitted to the elastic portion 2 so as to drive the tubular photosensitive film 1. The rod 3, the elastic portion 2, and the tubular photosensitive film 1 are rotated synchronously without slipping.

FIG. 3B is an enlarged view schematically showing the above described processing parts in contact with the photosensitive drum.

The photosensitive drum, which includes the elastic portion 2, forms a contact nip when the processing parts are pressed against the photosensitive drum. Although the appropriate contact nip cannot be formed on the conventional hard photosensitive drum, the appropriate contact nip can be formed with a low pressure in this invention.

According to the photosensitive drum for electrophotography, the tubular photosensitive film can be easily exchanged, so that the main parts of the drum can be recycled at low cost.

By choosing an appropriate elastic modulus of the elastic portion supporting the tubular photosensitive film, the pressure between the contact surfaces of the processing parts is reduced, and abrasion of the surfaces of the photosensitive component and other parts can be reduced.

This invention may be embodied in other forms or carried out in other ways without departing from the spirit thereof. The present embodiments are therefore to be considered in all respects illustrative and not limiting, the scope of the invention being indicated by the appended claims, and all modifications falling within the meaning and range of equivalency are intended to be embraced therein.

What is claimed is:

1. A photosensitive drum for electrophotography, comprising:

a tubular photosensitive film;

an elastic portion fit within said photosensitive film in contact with an inner surface of the photosensitive film; and a rod inserted into a hole of said elastic portion, an outside diameter of said rod being greater than an inside diameter of said hole so that said rod is tightly fit within the hole and that said elastic portion is elastically expanded and is pressed against the inner surface of said photosensitive film;

wherein said elastic portion has a sealed space surrounding the hole into which fluid or gas is injected so that said elastic portion is expanded.

2. A photosensitive drum according to claim 1, wherein said elastic portion is one of rubber, foamed rubber, plastic, or foamed plastic.

3. A photosensitive drum according to claim 1, wherein said rod has a round cross section.

4. A photosensitive drum according to claim 1, wherein said rod has a polygonal cross section.

5. A photosensitive drum according to claim 1, wherein said rod has a spline shape.

6. A photosensitive drum according to claim 1, wherein said rod is a screw shape.

7. A photosensitive drum according to claim 1, wherein said rod is hollow.

8. A photosensitive drum according to claim 1, wherein said rod extends over the full length of said elastic portion in the direction of the rotational axis of said tubular photosensitive drum.

9. A photosensitive drum according to claim 1, further comprising flanges with gears at both ends of said drum.

10. An electrophotography recorder, comprising a photosensitive drum, wherein said photosensitive drum comprises:

a tubular photosensitive film;

an elastic portion fit within said photosensitive film in contact with an inner surface of the photosensitive film; and a rod inserted into a hole of said elastic portion, an outside diameter of said rod being greater than an inside diameter of said hole so that said rod is tightly fit within the hole and that said elastic portion is elastically expanded and is pressed against the inner surface of said photosensitive film;

wherein said elastic portion has a sealed space surrounding the hole into which fluid or gas is injected so that said elastic portion is expanded.

11. An electrophotography recorder according to claim 10, wherein said elastic portion is one of rubber, foamed rubber, plastic, or foamed plastic.

12. An electrophotography recorder according to claim 10, wherein said rod has a round cross section.

13. An electrophotography recorder according to claim 10, wherein said rod has a polygonal cross section.

14. An electrophotography recorder according to claim 10, wherein said rod has a spline shape.

15. An electrophotography recorder according to claim 10, wherein said rod is a screw shape.

16. An electrophotography recorder according to claim 10, wherein said rod is hollow.

17. An electrophotography recorder according to claim 10, wherein said rod extends over the full length of said elastic portion in the direction of the rotational axis of said tubular photosensitive drum.

18. An electrophotography recorder according to claim 10, wherein said photosensitive drum further comprises flanges with gears at both ends of said drum.

* * * * *